United States Patent [19]

Marchetti

[11] Patent Number: 4,541,888

[45] Date of Patent: Sep. 17, 1985

[54] TAPING MACHINE FOR VARIABLE-SIZE CARTONS

[76] Inventor: Augusto Marchetti, Piazza Sicilia, 7, 20146 Milano, Italy

[21] Appl. No.: 463,668

[22] Filed: Feb. 4, 1983

[30] Foreign Application Priority Data

Mar. 16, 1982 [IT] Italy ..... 20169 A/82
Jun. 8, 1982 [IT] Italy ..... 22122/82[U]

[51] Int. Cl.[4] ..... B32B 1/00

[52] U.S. Cl. ..... 156/468; 53/137; 156/475

[58] Field of Search ..... 156/468, 475, 443; 53/137, 374

[56] References Cited

U.S. PATENT DOCUMENTS 4,161,138 7/1979 Marchetti ..... 53/137
4,438,617 3/1984 Ulrich et al. ..... 53/137

*Primary Examiner*—David Simmons

[57] ABSTRACT

Thrust members, for example idle rollers, supported by the taping head and disposed at the two sides of the carton support base, are approachable each other beginning from a mutual maximum removal position to exert opposite pressures on the carton sides, in order to limit the width of the upper longitudinal slot to be sealed. Preferably, the thrust members are firstly brought near the carton sides under elastic thrust and then pressed against them under pneumatic thrust.

13 Claims, 13 Drawing Figures

TAPING MACHINE FOR VARIABLE-SIZE CARTONS

BACKGROUND OF THE INVENTION

The present invention relates to a taping machine for variable-size cartons, that is of the so-called "self-sizing" kind.

The machines of that kind usually comprise a carton support base, advancement means in the shape of conveying belts transversally movable with respect to said support base and a taping head superimposed support base and vertically movable with respect to it.

The machines operate in such a way that at the introduction of a carton the conveying belts and the taping head are or place themselves immediately in a position suitable for receiving the carton, whatever its width and height size may be. Then they engage the carton sides and top to cause the carton to advance along the support base and apply sealing adhesive tape along the longitudinal slot existing between the two refolded upper lateral flaps of the carton.

These machines usually operate without difficulties, with the exception that, as a consequence of filling the carton the upper longitudinal slot may be too wide, making it difficult to effectively apply the sealing adhesive tape.

The object of the present invention is therefore to provide a taping machine of the above mentioned kind with suitable means in order to prevent the above mentioned difficulty.

According to the invention such an object is reached by means of a taping machine capable of handling different size cartons, comprising a carton support base, carton advancement means along said support base and a taping head superimposed above the support base and vertically movable with respect to it. The taping head pivotally supports at least one pair of support arms for thrust members for engaging the outer upper part of the carton sides to stress the sides toward each other. A control means is provided which operate on said arms so as to keep at rest said thrust members in a maximum position at the two sides of said support base and outward from the carton and to move them towards the pressure engagement will the carton sides when the carton is passed under said taping head.

In other words, by means of the above mentioned thrust members (for example constituted by idle roller or by sliding blocks in antifriction material) the machine according to the invention exerts on the carton sides a lateral retaining action, which brings the folded lateral flaps together and therefore into a suitable width of the upper slot to be sealed. The taping head can thus apply the sealing tape in the best way.

Preferably, the control means comprises both elastic means operating on the support arms of the thrust members so as to stress these members towards each other and means to exert on the support arms during the rest condition of the machine an opposite thrust greater than that of said elastic means. Upon the introduction of the carton under the taping head the control means releases the pneumatic force opposite the elastic means and applies a second thrust in the same direction as the elastic means.

In this way, the thrust members are able to approach immediately, with weak elastic thrust, the carton sides as soon as the carton is put in the machine. When the carton is in the sealing position, only then is the work pressure applied. It is thus made an elastic control advanced approach, which avoids the necessity of successive quick controls, fast movements and relative inertias, which could cause damage to the cartons and accidents to the operator.

DESCRIPTION OF THE PREFERRED EMBODIMENT

The features of the present invention will be better understood through the following detailed description of two embodiments illustrated by way of example in the enclosed drawings, in which.

DESCRIPTION OF THE PREFERRED EMBODIMENT

Figure 1:
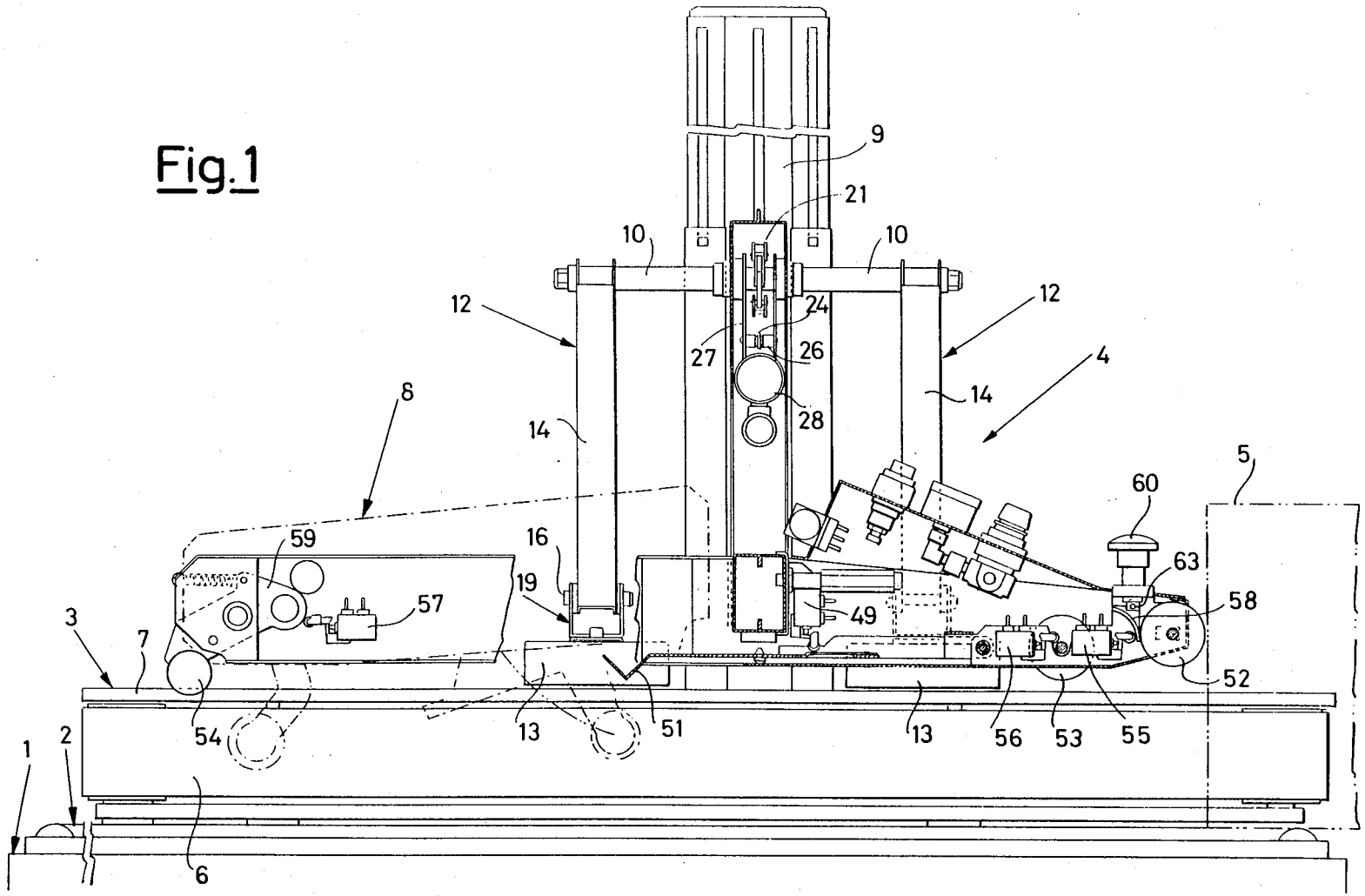
FIG. 1 shows a machine according to the invention in longitudinal section in rest conditions.

With reference to FIGS. 1–4, there is illustrated a taping machine for variable width and height cartons (generally indicated with 5 in the above mentioned Figures), which comprises a roller base 1 defining a support base 2 for the cartons to be sealed, two belt conveying units 3 and an upper taping head 4 above the support base 2.

The conveying units 3 are of the kind, known per se, constituted by closed-loop conveying belts 6 disposed around a plurality of operating and guide pulleys (shown in drawings), which with the above mentioned belts are housed inside respective carters 7. Through a pneumatic cylinder indicated with 18 in FIG. 8, the two conveying units 3 are transversally movable toward each other transversally with respect to the longitudinal axis of the support base 2. This allows the belts to engage the carton sides (FIG. 4) for advancing them along the support base 2 (from right to left, looking at FIGS. 1 and 2).

Figure 3:
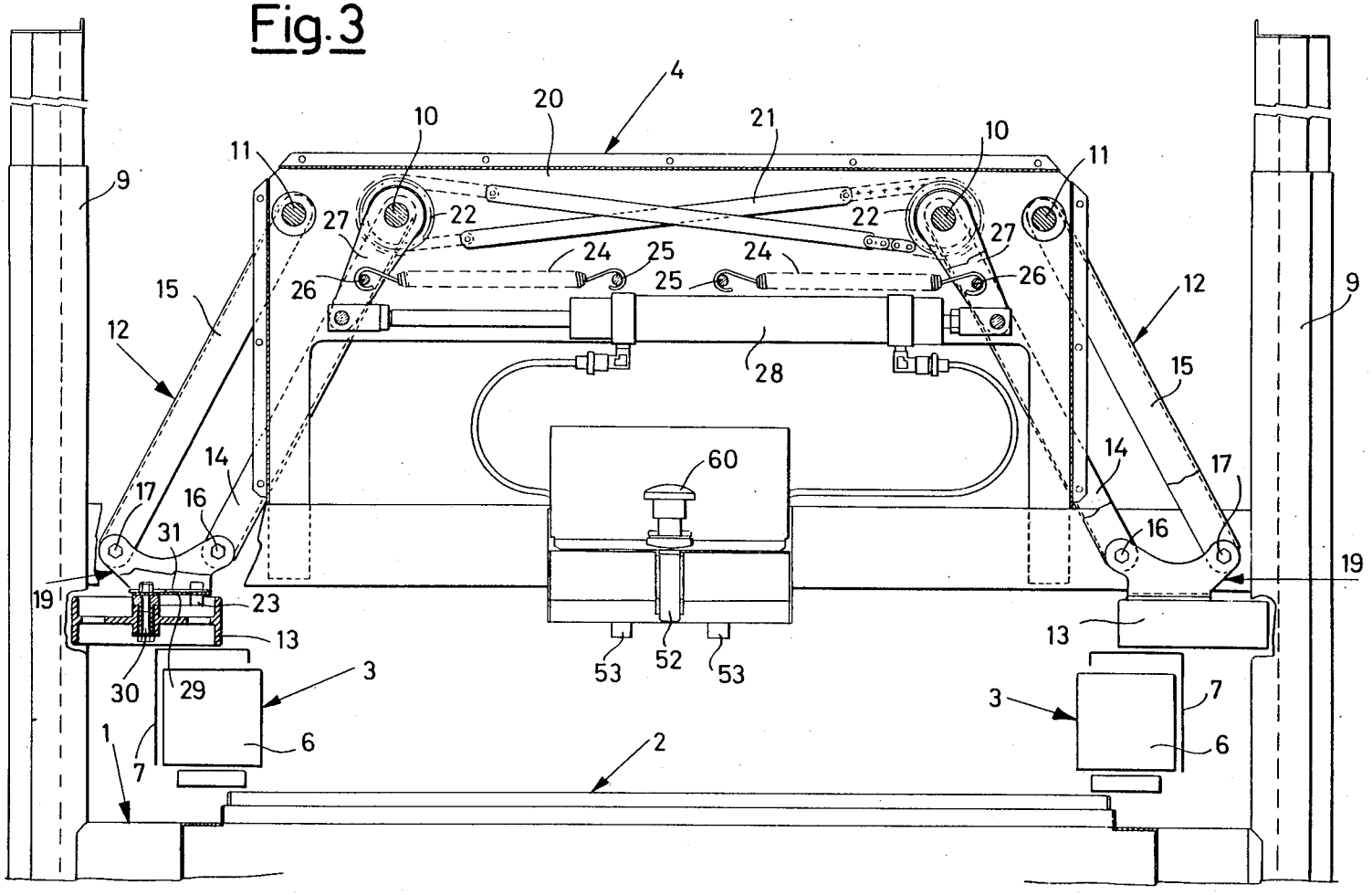
FIG. 3 shows said machine in transversal section in rest consitions.

The taping head is of the kind, known per se, which includes a taping unit 8 able to engage the carton top to apply a sealing adhesive tape along the central longitudinal slot defined between the folded upper lateral flaps of the carton. The taping head is vertically movable with respect to the support base 2 beginning from a minimum-height rest position, which is illustrated in FIGS. 1 and 3. This movement is guided by fixed columns 9 placed at the two sides of the support base 2 and is driven downward by the weight of the taping head 4 and upward by a pair of pneumatic cylinders 50 housed inside the columns 9.

Figure 4:
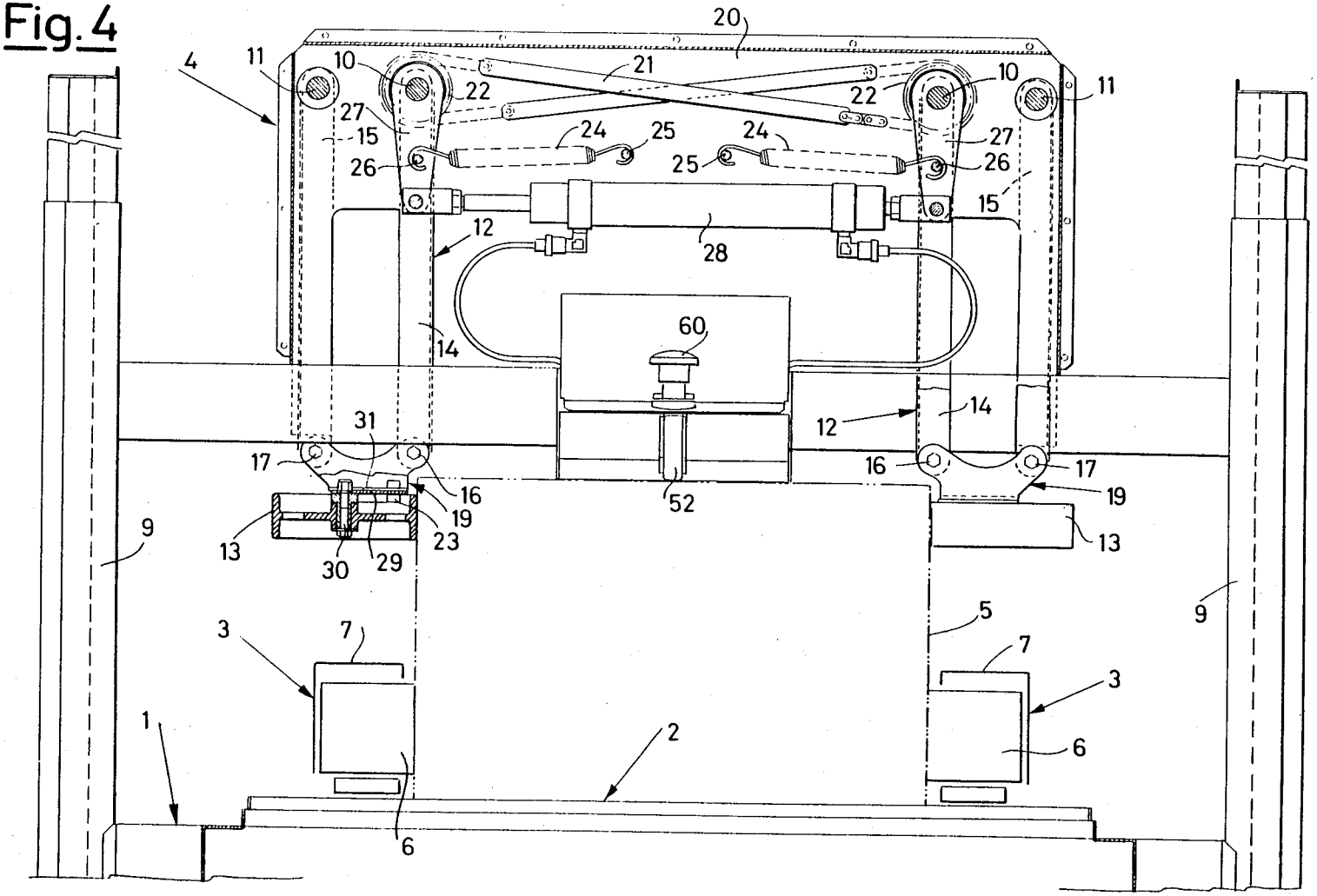
FIG. 4 shows said machine transversal section in work conditions.

Besides the taping unit 8, the head 4 rotatably supports, in longitudinally spaced positions, two pairs of articulated-parallelogram linkages 12 constituting support arms for respective idle rollers 13. More precisely, every support arm 12 is constituted by two connecting rods 14 and 15 pivoted on a portal-like structure 20 of the taping head 4 at rotating pivots 10 and 11. At the opposite ends of the arms 12 a support bracket 19 for a respective idle roller 13 is supported by pivots 16 and 17. The two support arms 12 are connected to each other by a chain 21 engaged with toothed wheels 22 integrally mounted on the rotation pivots 10. The chain is arranged in a figure eight so that the mutual approaching and removal movements of the two arms always have the same extension. Two springs 24 reacting between fixed pins 25 and pins 26 fixed to pairs of edges 27 made integral to the pins 10 (FIGS. 3 and 4) elastically stress the support arms 12 towards each other, and therefore cause the engagement of the idle rollers 13 with the carton sides (FIG. 4). A pneumatic cylinder 28 reacting between the above mentioned pairs of edges 27 can be controlled so as to apply said support arms with a force opposite and greater than the one of the spring 24 or a zero force or a force in the same direction with that of the above mentioned springs 24. The idle rollers 13, constituting thrust members able to stress the sides of the interposed cartons one towards the other, are thus kept in the maximum outward position of FIG. 3 (which is the rest position). The arms are then gently brought near the carton sides under the thrust of the elastic force of the springs 24 and finally pressed against those sides (FIG. 4).

Figure 6:
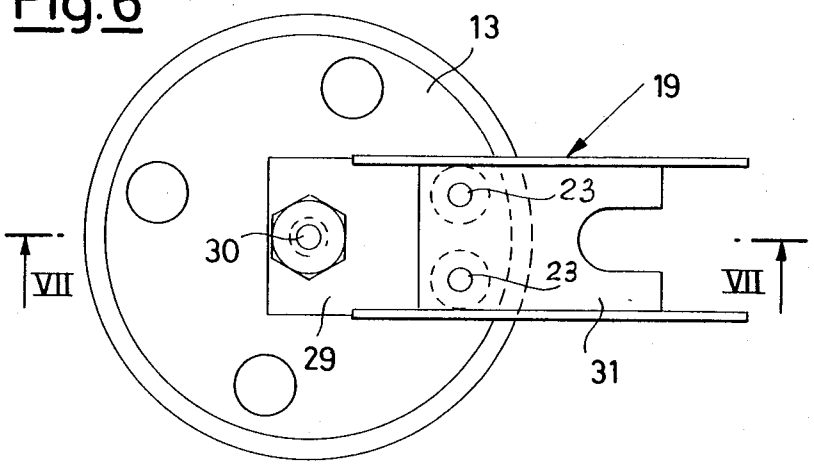
FIG. 6 shows a roller and support bracket in top plan but with the roller differently positioned with respect to the bracket.
Figure 5:
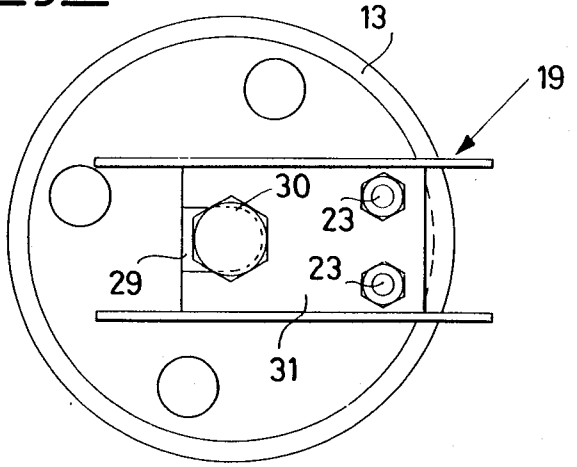
FIG. 5 shows the enlarged detail, in top plan, of an idle roller, and relative support bracket, which functions as a thrust member in the machine of the above mentioned Figures.
Figure 7:
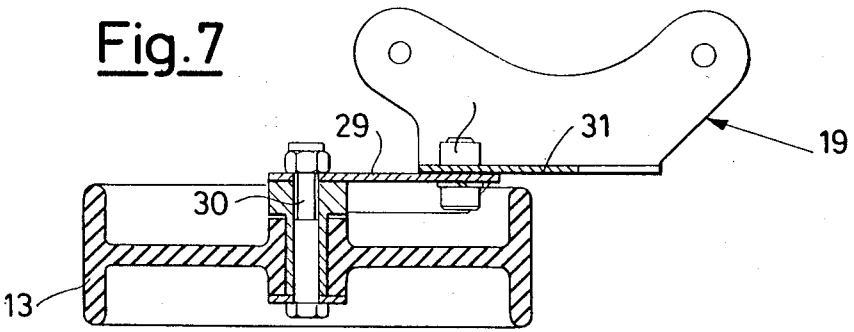
FIG. 7 shows said roller and said bracket in section along line VII—VII of FIG. 6.

As can be noted in FIGS. 3, 4 and 5, the fastening of the idle rollers 13 to the respective support brackets 19 is made by using an eccentric plate 29, to which the roller 13 is rotatably fixed by means of a screw 30 and which is in its turn fixed to the base 31 of the bracket 19 by means of screws 23. According to the mutual orientation of the plate 29 and of the base 31, the roller 13 can be substantially centered with respect to the bracket 19 (as in FIGS. 3–5) or displaced outwards with respect to it (as in FIGS. 6 and 7). This allows it to conform the maximum removal of the rollers 13 to a series of cartons of different maximum width. If desired, the idle rollers of the inlet pairs can be replaced with sliding blocks in anti-frictional material.

Figure 2:
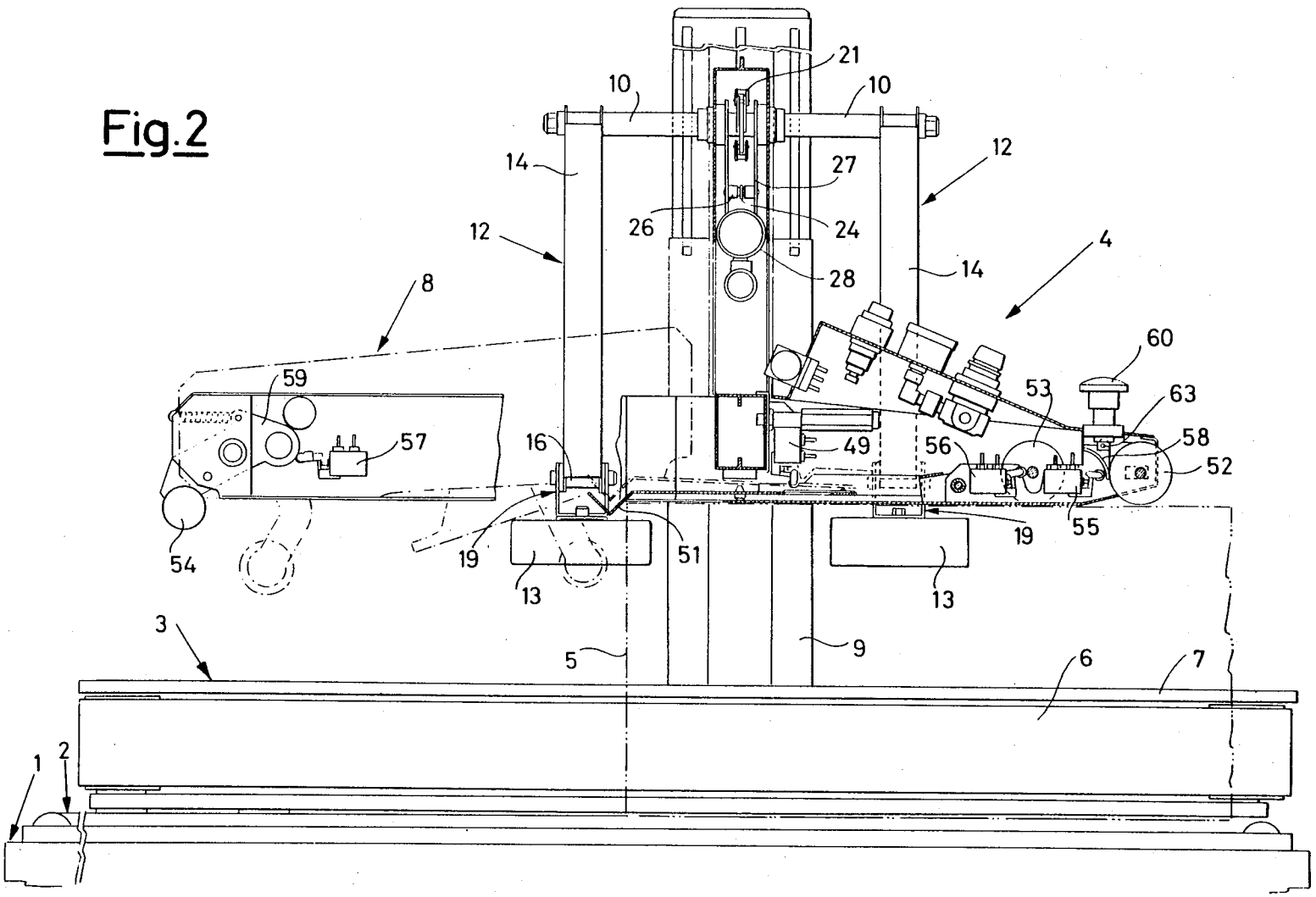
FIG. 2 shows said machine in longitudinal section in work consitions.
Figure 8:
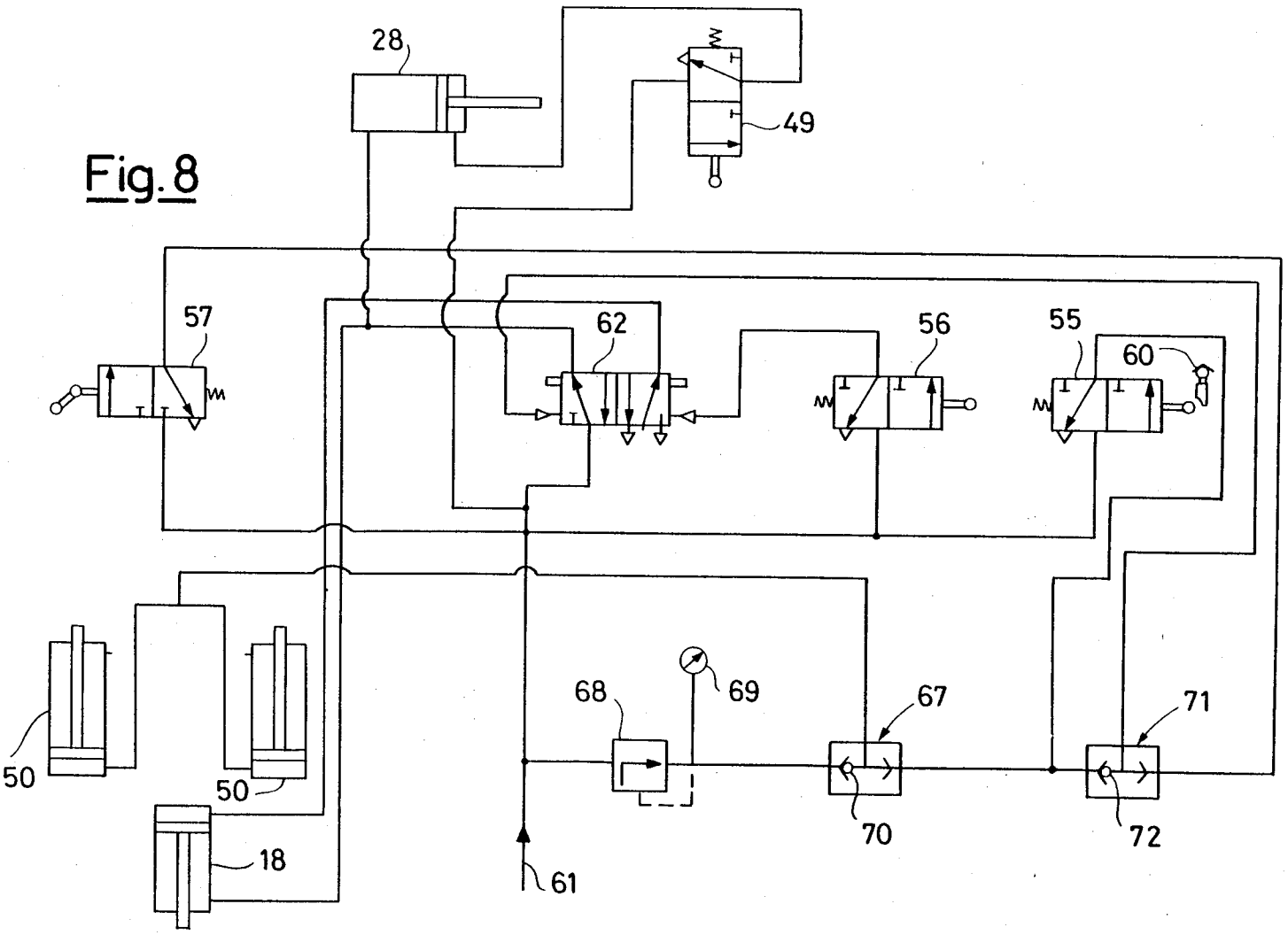
FIG. 8 shows the general diagram of the control pneumatic circuit of the above mentioned machine.

The taping head 4 also supports a series of sensors 52, 53, 51 and 54 connected to respective pneumatic valves 55, 56, 49 and 57 illustrated in FIGS. 1 and 2 and in the pneumatic scheme of FIG. 8. As can be seen from the above mentioned FIGS. 1 and 2, the sensor 52 is placed at the inlet of the sealing area defined by the taping head 4 to detect the arrival of a carton front and in such case to control the valve 55 through a flat spring 58. The sensor 53 is placed a little more ahead to detect the presence of the carton top under the taping head and to control in such case the actuation of the valve 56. The sensor 51 is placed just before the advanced pair of rollers 13 to detect the arrival of the front upper edge of the carton and in such case to control the actuation of the valve 49, and the sensor 54 is finally placed at the outlet of the sealing area to control through a lever 59 (stressed by a spring 73 in the position illustrated in FIGS. 1 and 2) and an unidirectional arm 74 the actuation of the valve 57 during the passage of the carton top.

Moreover, the taping head 4 has at its inlet end a pushbutton 60, whose stem 63 is normally kept in the raised position of FIGS. 1 and 2. The button can slide axially until it reaches a lowered position against the flat spring 58 where it controls the actuation of the valve 55.

The machine illustrated in the drawings also comprises a pneumatic control circuit (FIG. 8), which uses a compressed air feed 61 and a two-position distributing valve 62, the control of which is provided by the valves 56 and 57. According to its fixed position, the distributing valve 62 the pneumatic cylinder 18 which controls the relative movement of the conveying units 3; in combination with the valve 49, the valve 62 also controls the working of the pnuematic cylinder 28 interposed between the support arms 12 of the idle rollers 13. The position of the valve 55 determines the feed of air to the cylinders 50 for their operation to raise the taping head 4 or (with the valve 55 in the rest position of FIG. 8) to release the pressure from the cylinders 50 to lower the taping head 4. A flow cut-off valve 67 is interposed between the cylinders 50 and the valve 55 in order to fix a minimum air pressure to the discharge duct of the cylinders 50, and therefore the pressure exerted by the weight of the taping head 4 on the carton. The valve 67 is of the kind described in the U.S. Pat. No. 4,060,442. A control member 70 in the form of a ball is connected to a pressure regulator 68 with gauge 69 to a predetermined pressure which allows it to lock the air outflow from the cylinders 50 and towards the discharge of the valve 55 (in the position of FIG. 8) when the pressure of the air from the above cylinders 50 falls below said predetermined pressure as a result of the resting of the taping head 4 on the carton top. There is also provided a three-way connection element 71, one way of which, connected to the cut-off valve 67 and to the valve 55, is provided with a check valve 72.

By the effect of the described structure, the sealing machine illustrated in the drawings is destined for operating as follows. At rest, the distributing valve 62 being in the position of FIG. 8, the compressed air coming from line 61 actuates the pistons of the cylinders 18 and 28 to the raised position of the conveying units 3 and, to overcome the action of the springs 24 and thus keep the idle rollers 13 in the position outward from the cartons as shown in FIG. 3. The rest position of the valve 55 on the other hand keeps the cylinders 50 in the lowered position which corresponds the disposition of the taping head 4 (stressed by its own weight) in the lowered rest position, which is illustrated in FIGS. 1 and 3.

During the introduction of a carton to be sealed (with upper and lower flaps already folded in closed position), the front wall of the carton contacts the inlet sensor 52, which actuates the valve 55. Compressed air is consequently fed through the valve 55 and the cut-off valve 67 (with the control member 70 in the position of FIG. 8) to the cylinders 50, which causes the raising of the taping head 4 up to the point of the engagement between the carton and the sensor 52. While the carton is still subjected to a brief manual advancement, the valve 55 then comes back in the rest position of FIG. 8, connecting to discharge the cylinders 50 through the cut-off valve 67, whose control member 70, by moving from left to right with respect to FIG. 8, locks the outflow of the air from the cylinders 50 as soon as the pressure in the discharge duct goes below the predetermined value fixed by the regulator 68 as a consequence of the fact that the taping head 4 is touching the top of the carton; the resting of the taping head happens therefore at suitable predetermined pressure. The engagement of the taping head 4 with the top of the carton also causes the operation of the sensor 53 and the consequent actuation of the valve 56, which in its turn causes the actuation of the distributing valve 62. Through this latter, compressed air is then fed to the upper chamber of the cylinder 18, while the lower chamber of the cylinder 18 and the left chamber (looking at FIG. 8) of the cylinder 28 are connected to discharge. The cylinder 18 controls then the mutal approaching of the conveying units 3 and the engagement of the conveying belts 6 with the sides of the carton, which is then advanced through the sealing area. At the same time, the cylinder 28 allows the springs 24 to bring the rollers 13 near the carton sides with a weak elastic thrust which avoids any danger of accident for the operator.

While the sensor 53 is still in engagement with the carton top, the upper front edge of the carton engages the sensor 51 (situation illustrated in dash-dot line in FIG. 2), which through the valve 49 releases the air feed in the right hand chamber (looking at FIGS. 3, 4 and 8) of the cylinder 28. This allows the four rollers 13 to be pressed against the carton sides, exerting a horizontal thrust (owing to the parallelogram shape of the arms 12), which compensates for possible swellings of the sides and therefore keeps the width of the upper longitudinal slot of the carton within the desired limits.

Still with the sensor 53 in engagement with the carton top, there is then engaged the outlet sensor 54, which through the lever 59 acts on the articulated arm 74, but, because of the unidirectional hinge of this latter, has no effect on the valve 57, which therefore remains in the rest position illustrated in FIG. 8. The sensor 54, however, remains raised, against the reaction of the spring 73, as so kept by the underneath carton.

Nothing happens at the release of the sensor 53, while the successive release of the sensor 51 causes the connection of the right chamber of the cylinder 28 to discharge and therefore the release of the pressure exerted by the rollers 13 on the carton sides.

When the carton goes out of the sealing area, the release of the sensor 54 occurs. Because of the unidirectional hinge of the arm 74, this causes now the actuation of the valve 57 and consequently the generation of a control pulse, whose result is to cause the return of the distributing the valve 62 to the rest position of FIG. 8. Compressed air is then fed to the lower chamber of the cylinder 18 and to the left chamber of the cylinder 28, the first one of which causes the mutual removal, that is the "opening", of the conveying units 3, while the second one, overcoming the action of the springs 24, causes the mutual removal of the thrust rollers 13 up to the rest position of FIG. 3. The taping head 4, no longer held by the underneath carton, goes down by gravity in the initial position of minimum height.

Carton defects or other difficulties can sometimes cause the cartons to jam inside the sealing area, when the valves 55 and 57 are in the rest position of FIG. 8, the valves 56, 49 and 62 are in unchanged position and the taping head 4 is laid on the top of the carton and the conveying units 3 and the thrust rollers 13 are engaged with the carton sides.

If this happens, there is provided a quick remedy, represented by the pushbutton 60. By pushing it downwards, it is possible to cause new actuation of the valve 55, which on one hand causes through the cylinders 50 the lifting of the taping head 4 in position of maximum distance from the support base 2 and on the other hand causes through the connection element 71 the opposed actuation of the distributing valve 62 for the feeding of compressed air to the lower chamber of the cylinder 18 and to the left chamber of the cylinder 28 and the consequent removal of the conveying units 3 and of the thrust rollers 13. One thus obtains the complete "opening" of the sealing area for the free, easy and sure access to the carton by the operator. By pulling up again the pushbutton 60, the valve 55 also can thus come back to rest, making the taping head 4 go down in rest position and therefore preparing again the machine in a condition suitable for the operation on a new carton to be sealed.

The machine illustrated in FIGS. 9–13 is basically the same as the one described above and contains many of the same constructive details. Therefore only the differences will be described. The components identical or completely equivalent to those of the already described machine are indicated with the same reference numbers.

The differences between the two machines are entirely in the support and displacement system of the arms 12, as well as in their construction. In the case of the machine illustrated in FIGS. 9–12 the support arms 12 are constituted by simple cylindrical bars which carry the rollers at one end in an arcuate path. The upper ends are fixed to respective rotation pins 75 pivotally supported by the portal-like structure 20. As particularly shown in FIGS. 11 and 12, on every pin 75 there is fixed one of the two sector gears 76, identical and symmetrically disposed, which mesh with respective opposed rack-shaped sides 77 of an interposed sliding plunger 78 fixed to the free end of the piston stem of the pneumatic cylinder 28. Unlike the corresponding cylinder 28 of the machine of FIGS. 1–8, the cylinder is vertically mounted on the top of the portal-like structure 20. Only one spring 24 (instead ot two aligned ones as in the machine previously described) reacts between a pair of brackets 79 fixed to a pair of the above mentioned support arms 12 to elastically stress the two pairs of support arms, and therefore the idle rollers 13, towards a mutual minimum removal position.

Other two idle pins 80 are provided at the two sides of the pins 75 and parallel to them. Their function can be understood by looking at FIG. 13, which shows how each of the two arms 12 can be connected to the adjacent pin 80, rather than to the respective pin 75. The two adjacent pins 80 and 75 on the other hand can be operatively connected by an articulated-parallelogram system formed by two levers 81 and 82 keyed on respective pins 75 and 80 and by a connecting rod 83. Of course, the same parallelogram system is repeated for the other pairs of pins 75 and 80 with relative analogous disposition of the arm 12.

Figures 9, 13:
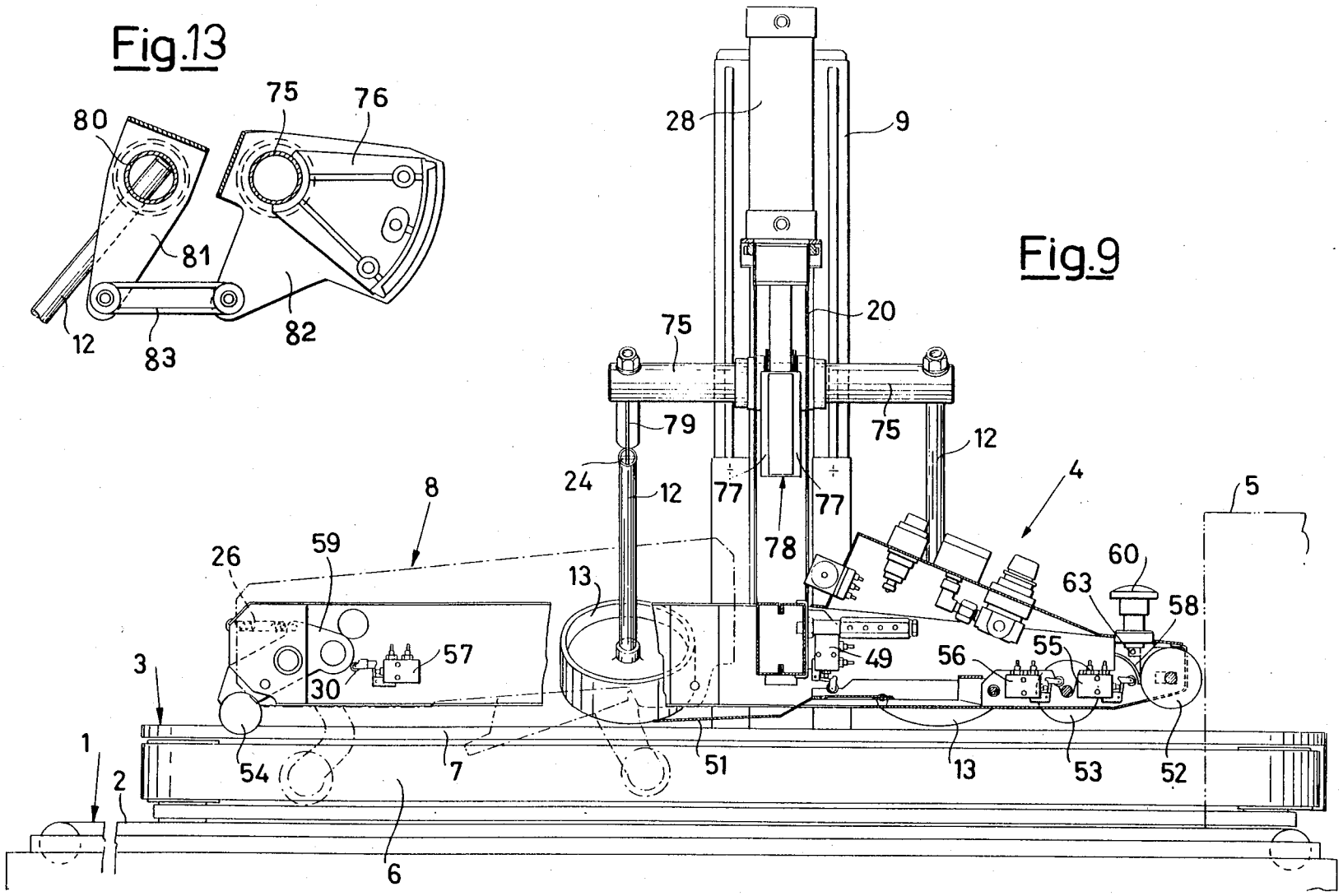
FIG. 9 shows another machine according to the invention in longitudinal section in rest conditions.
FIG. 13 shows a detail of the machine of FIGS. 9–12, made suitable for an use of the machine with cartons of greater width.
Figure 10:
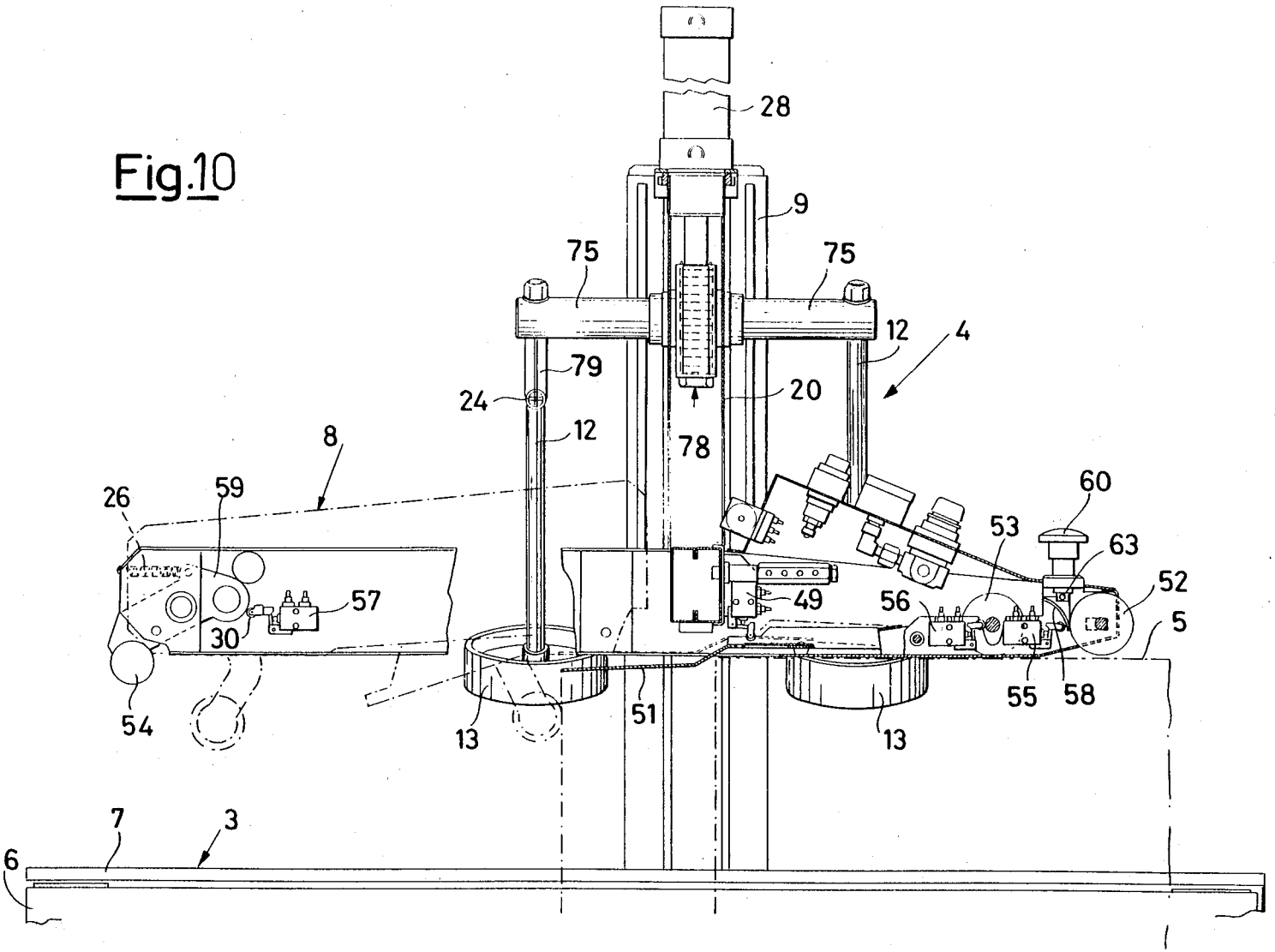
FIG. 10 shows said other machine in longitudinal section in work conditions.
Figure 11:
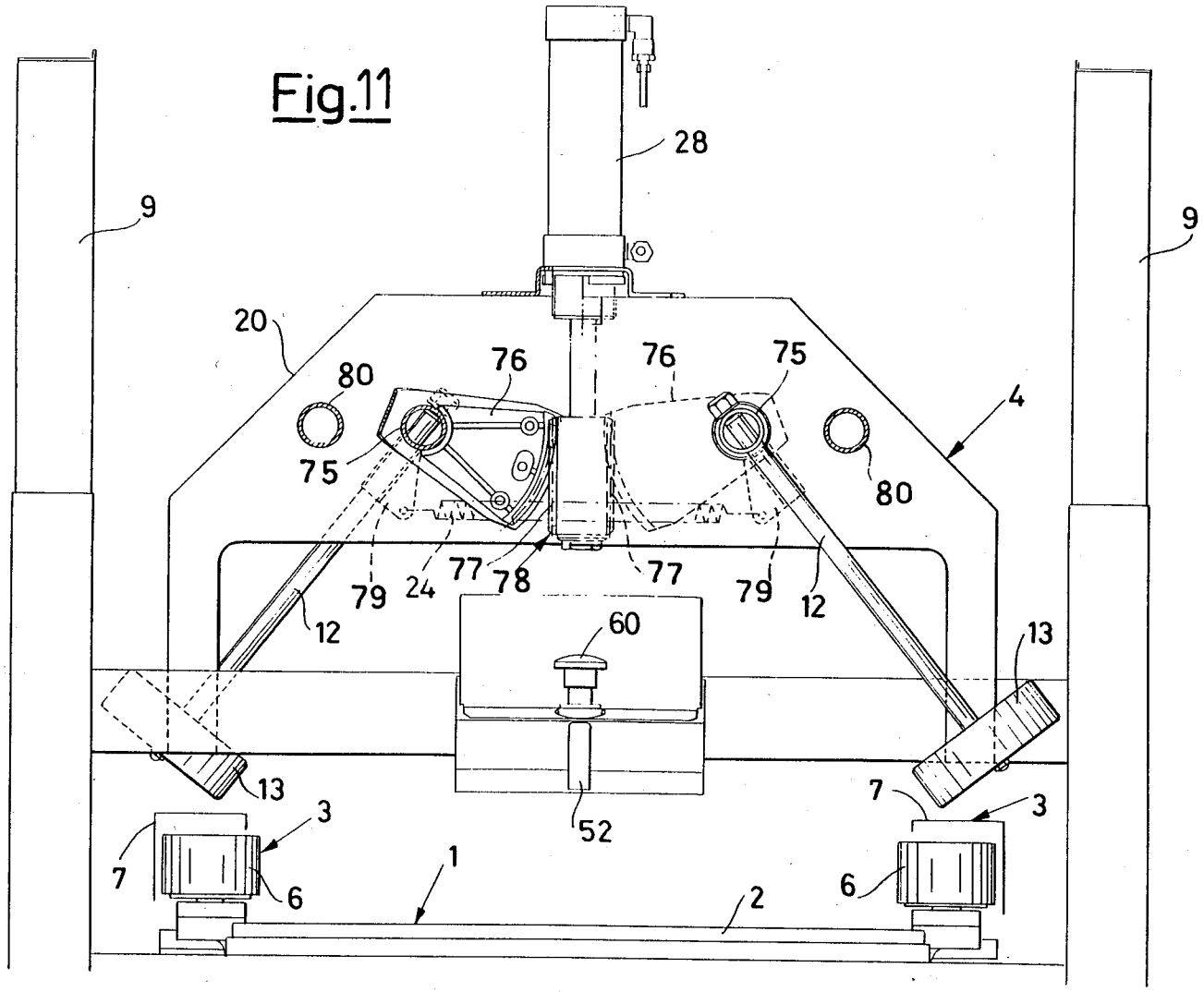
FIG. 11 shows said other machine in transversal section in rest conditions.
Figure 12:
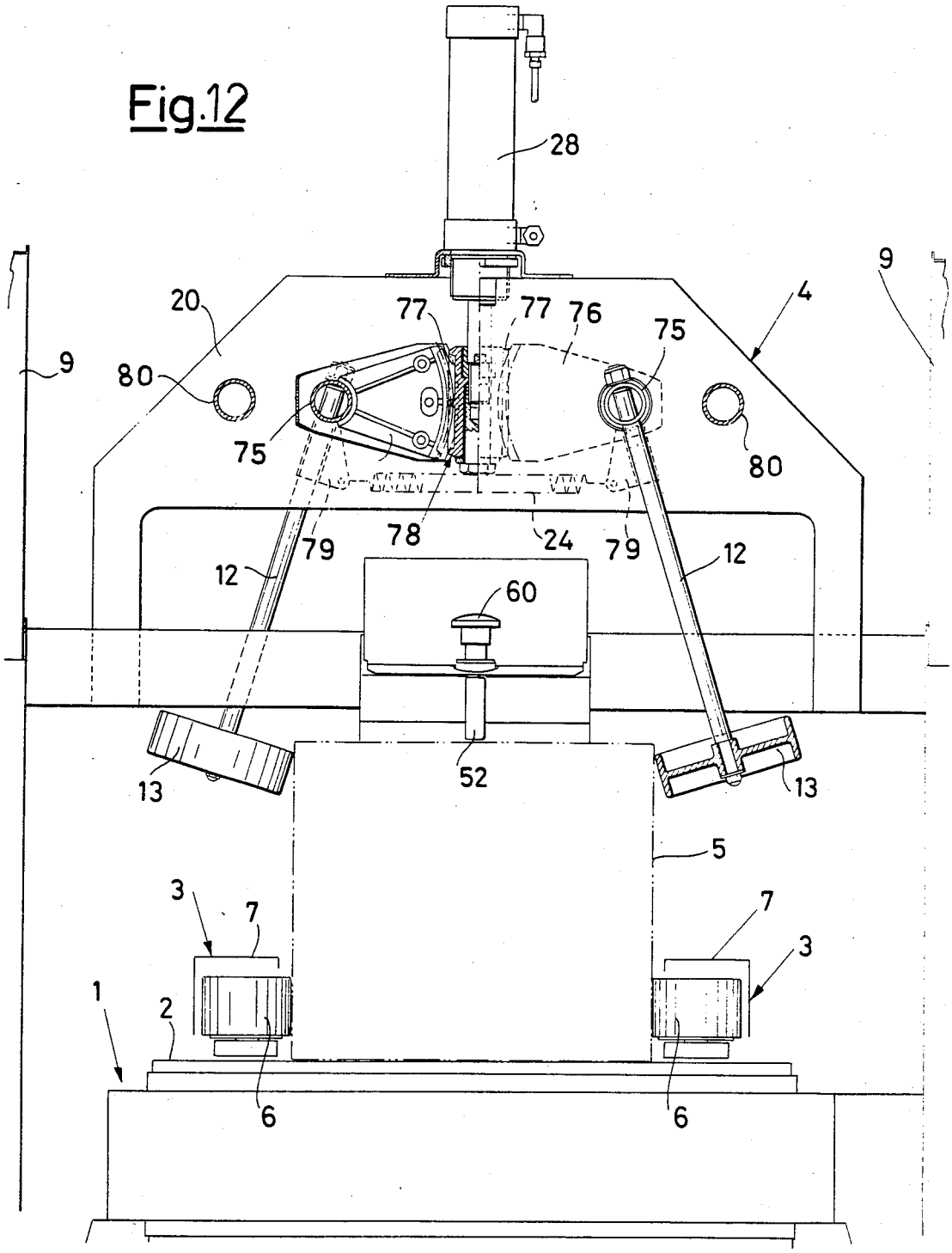
FIG. 12 shows said other machine in transversal section in work conditions.

It is evident that, by moving the support arms 12 from the pins 75 to the outer pins 80 and connecting the two pairs of pins with the parallelogram systems illustrated in FIG. 13, it is possible to move the endstroke of the rollers 13 outwards, while maintaining unchanged the stroke extension, so as to make the machine suitable for cartons of greater width.

For the working of the machine of FIGS. 9–13 there is a pneumatic control circuit, which is completely identical to that of FIG. 8, so that neither the illustration nor the detailed description is repeated. The only difference is that since the cylinder 28 is now in the vertical position, it is the lower chamber that is connected as the right chamber of the corresponding cylinder of the machine of FIGS. 1–8, and the upper chamber as the left one of the above mentioned machine.

Even the working way of the whole machine is the same. On the contrary, of course, the motion transmission system from the cylinder 28 to the arms 12 changes and in this case provides at rest that the operation of the cylinder 28 in the lowering of the relative piston, which operation is obtained by feeding the upper chamber of the cylinder, controls the rotation of the arms 12 for the maximum mutual removal of the rollers 13 against the opposition of the spring 24 by the engagement between the racks 77 of the sliding plunger 78 and the sector gears 76 integral with the pins 75. At the moment of the introduction of a carton, in absence of such an operation, more precisely as a result of the discharge connection of the upper chamber of the cylinder 28, the spring 24 exerts on the arms 12 a limited thrust of mutual approaching, which allows the rollers 13 to lay against the carton sides. The successive opposite operation of the cylinder 28, obtained by connection of the above mentioned lower chamber to discharge and feed of the lower chamber, finally allows, still through the rack 77 and the sector gears 76, to give the arms 12 and consequently the rollers 13 the required pressure to compensate the possible swellings of the carton sides.

I claim:

1. Taping machine capable of handling different sized cartons, comprising a carton support base, carton advancement means along said support base and a taping head superimposed above said support base and vertically movable with respect to it, characterized in that said taping head pivotally supports at least one pair of support arms for thrust members for engaging the upper edge of carton sides to stress the sides towards each other, there being provided control means to actuate said arms to move them towards the pressure engagement with the carton sides when the carton is passed under said taping head, said thrust members having a rest position outwardly of said support base.

2. Taping machine according to claim 1, characterized in that said thrust means are idle rollers.

3. Taping machine according to claim 2, characterized in that said idle rollers are connected to said support arms by means of variable orientation brackets, which allow the rollers to be positioned outwards or inwards on the support arms.

4. Taping machine according to claim 3, characterized in that said brackets include a base plate which can be fixed with variable orientation to an eccentric plate fixed to the respective roller.

5. Taping machine according to claim 1, characterized in that said thrust means comprise sliding blocks of antifriction material.

6. Taping machine according to claim 1, characterized in that it comprises two pairs of said support arms, said pairs being mutually spaced in the carton advancement direction along said support base.

7. Taping machine according to claim 1, characterized in that said support arms are constituted by articulated-parallelogram linkages.

8. Taping machine according to claim 1, characterized in that said control means comprise elastic means acting on said support arms so as to yieldingly stress said thrust means towards a rest position and fluidodynamic means acting on said support arms to exert thereon an opposite thrust greater than that of said elastic means during the rest condition of the machine, the control means able to release said opposite thrust during the introduction of a carton under said taping head and successively to apply a thrust of said elastic means during the passage of the carton under said taping head, so that thrust means are elastically stressed towards the engagement with the carton sides during the introduction of the carton and are pressed against the sides during the successive carton advancement under said taping head.

9. Taping machine according to claim 8, characterized in that said fluidodynamic means are constituted by a double-effect cylinder interposed between said support arms and provided with a control circuit including a first valve responsive to the introduction of the carton under said taping head and a second valve responsive to the attainment of a more advanced position under said taping head by said carton, said first valve controlling the complete deactuation of said cylinder and said second valve controlling the actuation of said cylinder to exert said thrust on said support arms.

10. Taping machine according to claim 8, characterized in that said fluidodynamic means comprise a cylinder-piston group, on whose stem there is fixed a sliding plunger with opposite rack-shaped sides, with which there are engaged opposite sector gears, made integral to said support arms coaxially to the rotation axes of the sector gears.

11. Taping machine according to claim 1, characterized in that said taping head supports a first pair of rotation pins of said support arms and at least one second pair of rotation pins parallel to said first pins, said support arms being movable from the first to the second pins and said pins being connectable to each other by means of articulated parallelogram linkage system.

12. A taping machine capable of handling different size cartons comprising a support base, a carton advancement means along the support base, a taping head disposed above the support base, the taping head having at least one pair of pivotally connected arms, each arm having a thrust member at one end, a control means to raise and lower the taping head and to control arm movement, the control means sensing the presence of a carton and lowering the taping head to contact the carton while pivoting the arms such that the thrust members contact the upper side edges of the carton thereby bringing top flap portions of the carton together for taping.

13. A taping machine capable of handling different size cartons comprising a support base, a carton advancing means along the support base, a taping head disposed above the support base, at least one pair of arms pivotally connected at one end to the taping head, each arm having a thrust member member at the opposite end, at least one spring connecting the arms to urge them towards each other, a pneumatic cylinder connecting the arms capable of urging the arms selectively inwardly towards each other and outwardly away from each other against the spring tension, a control means capable of raising and lowering the taping head and further being capable of actuating the pneumatic cylinder, the control means being capable of sensing the presence of carton having its closure flaps in the closed position whereby the taping head is lowered to contact the carton and the pneumatic cylinder allows the arms to be moved towards each other by the spring tension and subsequently apply a force in the same direction as the spring, the arms and thrust member arranged such that their movement toward each other causes the thrust members to contact the upper sides of the carton to urge the closure flaps together while the taping head seals the carton.

* * * * *